US005357994A

United States Patent [19]

Chung

[11] Patent Number: 5,357,994

[45] Date of Patent: Oct. 25, 1994

[54] HIDDEN SAFETY CONTOURED LEAF SPRING LOCKING DEVICE

[76] Inventor: Wen C. Chung, 58, Ten Shing Li, Hsinpu Cheng, Hsinchu Shien, Taiwan

[21] Appl. No.: 233,881

[22] Filed: Apr. 26, 1994

[51] Int. Cl.[5] ..... A45B 25/14

[52] U.S. Cl. ..... 135/22; 135/28; 135/40

[58] Field of Search ..... 135/22–24, 135/28, 37, 38, 39, 40, 41, 42

[56] References Cited

U.S. PATENT DOCUMENTS

| | | | |
|---|---|---|---|
| 1,091,895 | 3/1914 | Schaap | 135/24 X |
| 1,113,769 | 10/1914 | Fretz | 135/22 |
| 3,677,274 | 7/1972 | Yasuda et al. | 135/24 |
| 5,020,558 | 6/1991 | Huang | 135/24 |
| 5,232,004 | 8/1993 | Wu | 135/28 X |

FOREIGN PATENT DOCUMENTS

| | | | |
|---|---|---|---|
| 542357 | 4/1956 | Italy | 135/38 |

*Primary Examiner*—Lanna Mai

*Attorney, Agent, or Firm*—Morton J. Rosenberg; David I. Klein

[57] ABSTRACT

The invention herein relates to a kind of hidden safety contoured leaf spring positioner device for umbrella structures that is comprised of a center pole, a sliding strut spreader, a handle connector, contoured leaf spring and other components, wherein the tensility of the contoured leaf spring is utilized to produce a special locking function and is installed in a round positioning hole of the positioning cavity inside the sliding strut spreader, thereby enabling an umbrella to be actively and safely locked when opened or closed.

1 Claim, 6 Drawing Sheets

HIDDEN SAFETY CONTOURED LEAF SPRING LOCKING DEVICE

BACKGROUND OF THE INVENTION

The invention herein is a kind of safety positioner device for utilization in general umbrella structures and is designed for conventionally used umbrella products, especially automatic umbrella structures that are often subject to the phenomenon of inconsistent locking operation, wherein the umbrella tends to naturally revert to the open mode, or wherein the angular disposition of the manually operated locking spring has the shortcoming of causing excessive pressure and pain to the fingers.

The primary objectives of the invention herein are concerned with improving the aforementioned shortcomings by enabling the precision alignment of the contoured leaf spring, the sliding strut spreader and the center pole and thereby produce comfortable and safe operation.

The following drawings accompany the detailed description of the preferred embodiment of the invention herein.

DETAILED DESCRIPTION OF THE INVENTION

Figure 1:
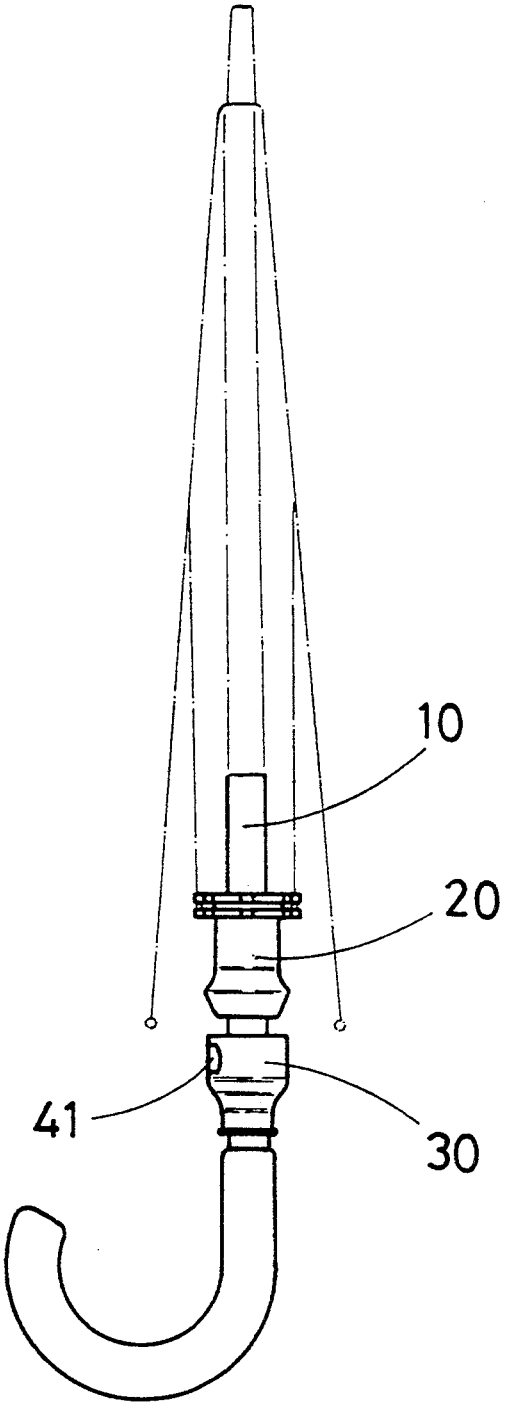
FIG. 1 is an orthographic drawing of the invention herein.
Figure 2:
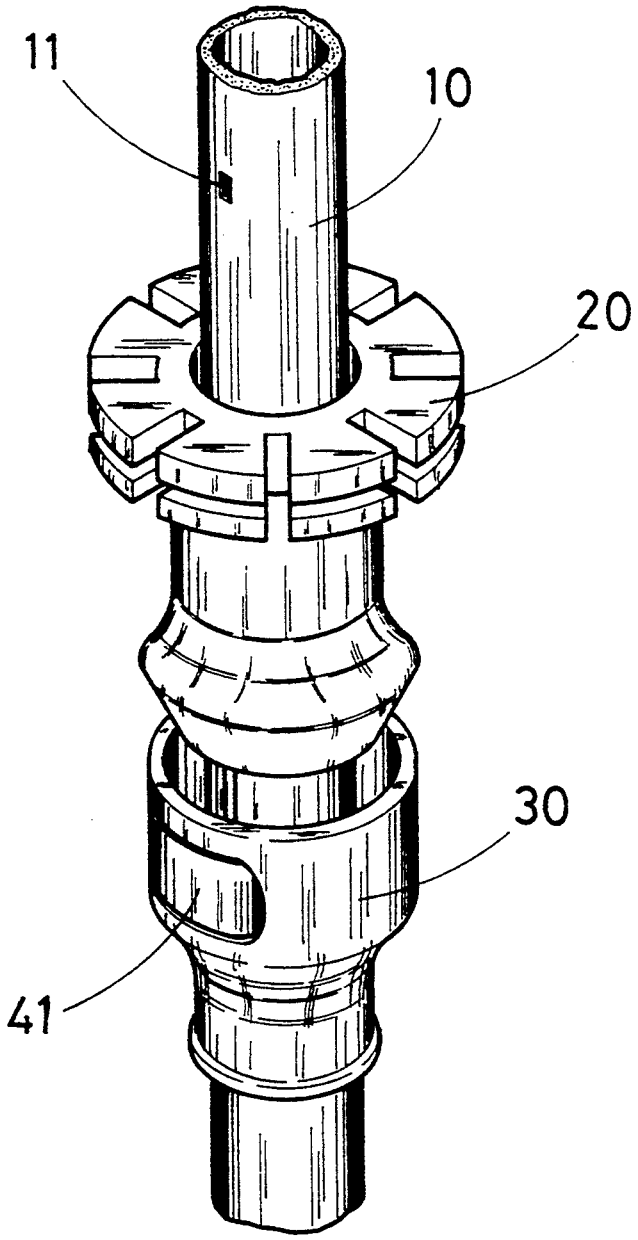
FIG. 2 is an isometric drawing of the major section of the invention herein.
Figure 3:
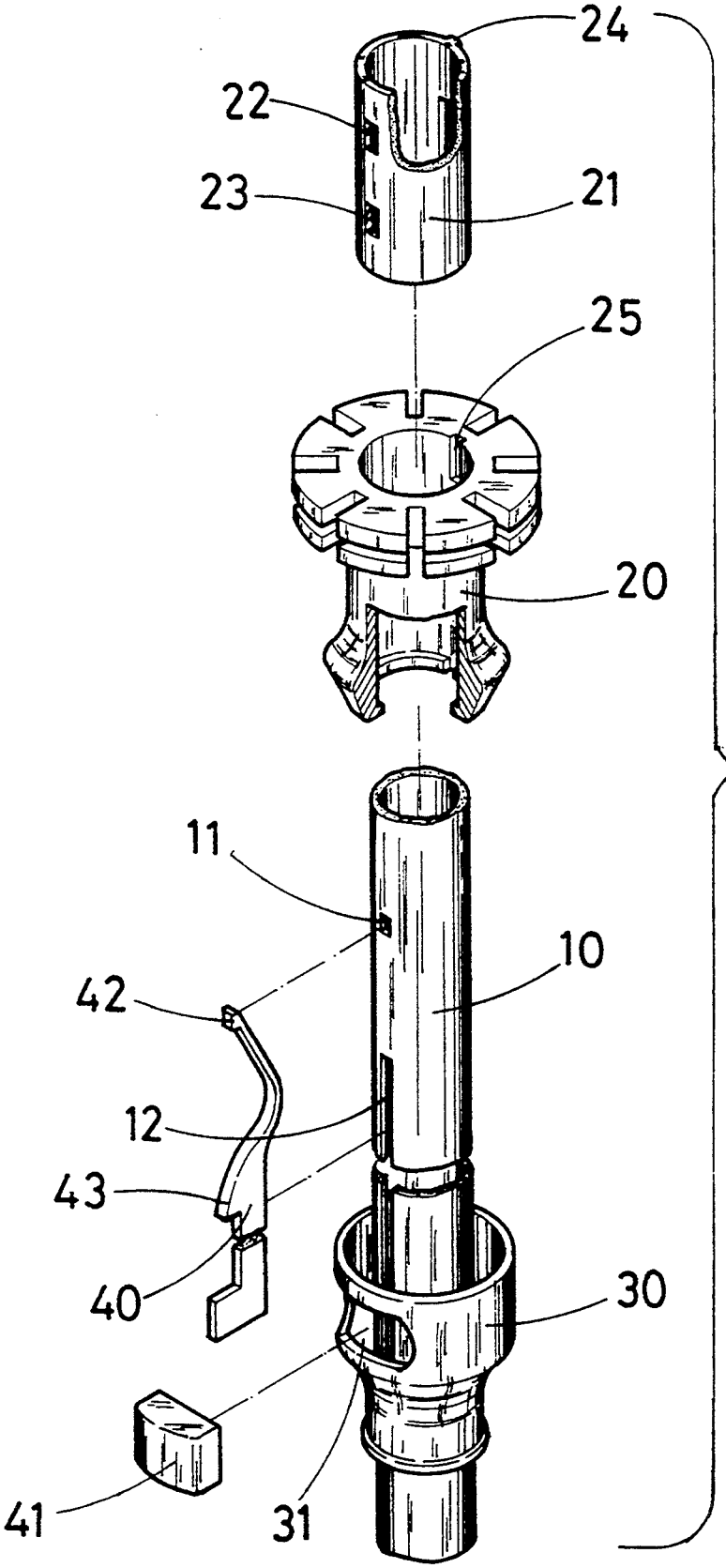
FIG. 3 is an isometric exploded drawing of the invention herein.

As indicated in the drawings, the invention herein is comprised of a center pole (10), sliding strut spreader (20), handle connector (30) and contoured leaf spring (40).

Of which, at the lower end of the center pole (10) is a small hole (11) and a narrow long slot (12) which are utilized to insert the contoured leaf spring (40).

At the location of the sliding strut spreader (20) within the structure of the umbrella, there is an internal hollow positioning tube (21) that fits inside the sliding strut spreader (20) and also has a protruding tab (24) which fits into the positioning slot (25) of the sliding strut spreader (20), and the center pole (10) is inserted through the sliding strut spreader (20); there are two positioning holes (22) and (23) in the positioning tube (21) which serve as mounts for the contoured leaf spring (40). The handle connector (30) is situated at the upper part of the handle and has an insertion hole (31) for the contoured spring actuator (41) to protrude outward.

The shape of the contoured leaf spring (40) is of innovative design in that there is a spring actuator (41) at its lower end that protrudes through the insertion hole (31) in the handle connector (30), and this constitutes the umbrella opening and closing control section. The upper half of the contoured leaf spring (40) consists of a slender arched structure with a bent point (44) that contacts the inner wall of the center pole (10) and at the uppermost end is another support point (42), which is the active upper support end of the contoured leaf spring (40) that is inserted into the small hole (11) in the center pole (10); at the center of the contoured leaf spring (40) is a pawl (43) that interlocks in the positioning hole (11) of the sliding strut spreader (20), thereby enabling the rigid configuration of the umbrella framework, wherein the entire contoured leaf spring (40) is inserted through the slot (12) in the center pole (10) and installed inside the center pole (10).

Figure 4:
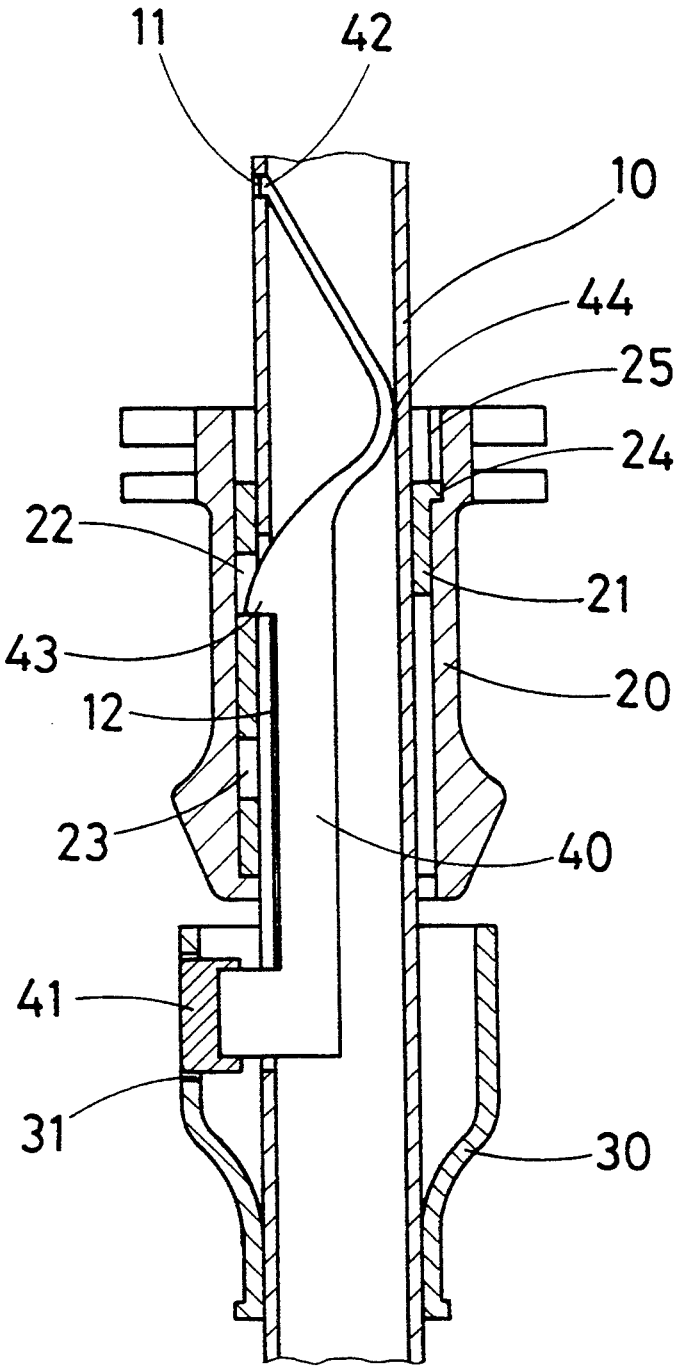
FIG. 4 is a cross-sectional drawing of the invention herein depicting the transition of the umbrella framework into the fully closed mode.

As indicated in FIG. 4, when the umbrella is in the completely closed mode, the lowering of the sliding strut spreader (20) causes the pawl (43) of the contoured leaf spring (40) to interlock in the positioning hole (22) and enable the closure of the umbrella.

Figure 5:
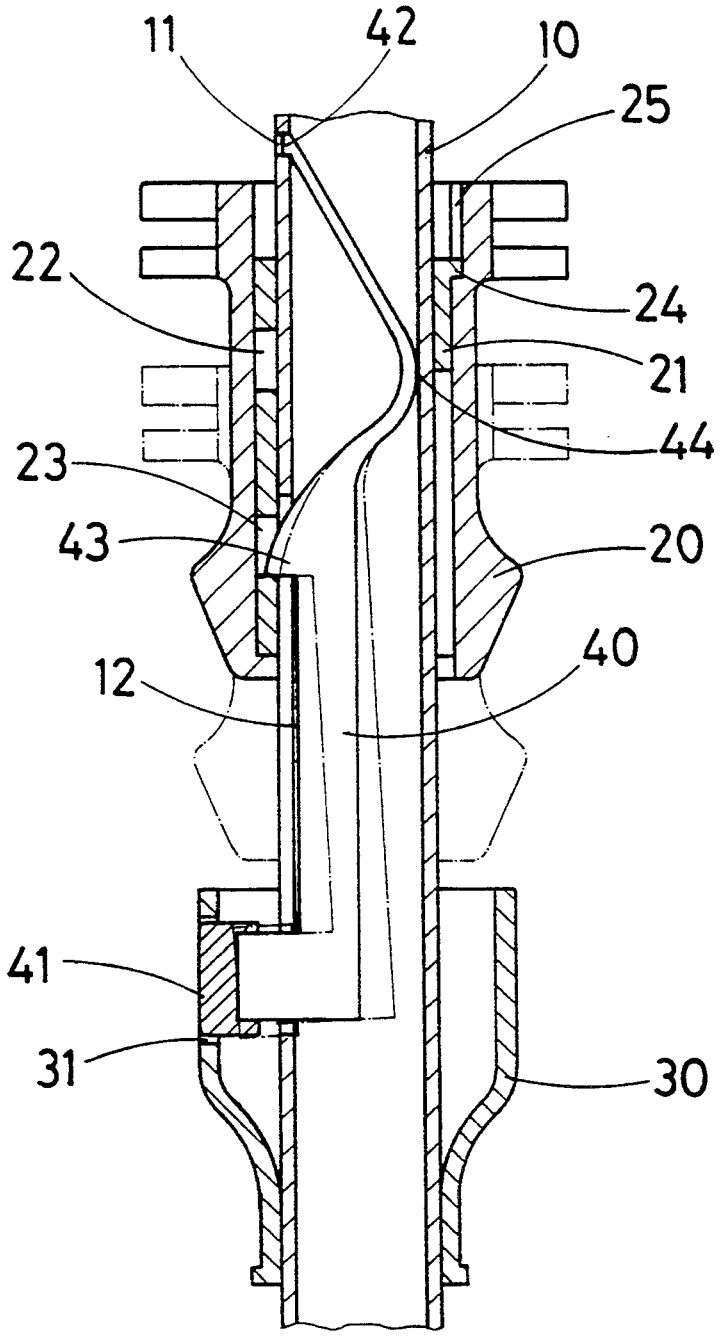
FIG. 5 is another cross-sectional drawing of the invention herein illustrating the transition of the umbrella into the open mode.

As indicated in FIG. 5, when the umbrella is in the fully opened mode, the spring actuator (41) must be depressed to displace the support point (42) of the contoured leaf spring (40) that is in the small hole (11), and the operation of the bent point (44) enables the depression of the aforesaid actuator and the removal of the pawl (42) from the positioning hole (22), after which the tensility of the umbrella structure itself is utilized (not indicated in the drawings) to cause the upward movement of the sliding strut spreader (20) and thus complete the opening operation of the umbrella.

Figure 6:
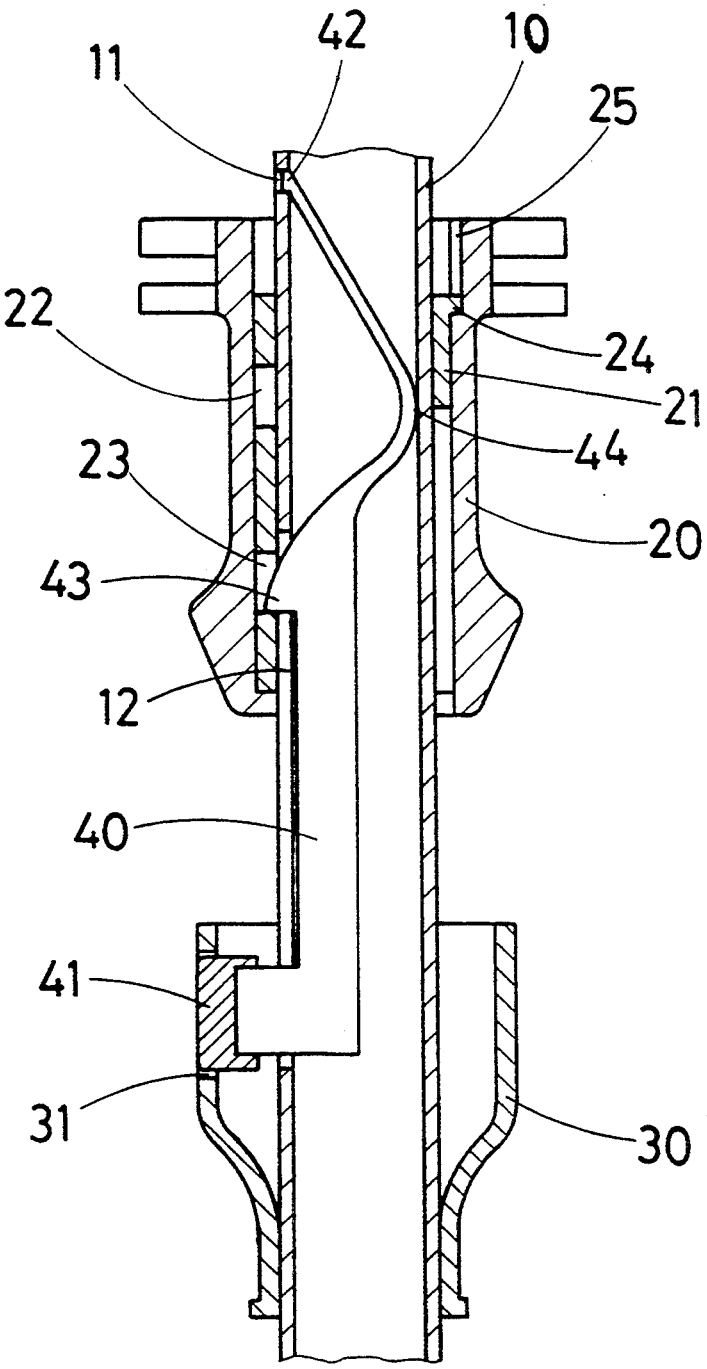
FIG. 6 is yet another cross-sectional drawing of the invention herein showing the safety structure that prevents the umbrella from opening inadvertently.

When the spring actuator (41) is pressed inadvertently or a sufficient degree of accidental force causes the disengagement of the pawl (43) from the positioning hole (22), the sliding strut spreader (20) is moved upward: however, since the contoured leaf spring (40) of the invention herein permits the pawl (43) originally inserted in the positioning hole (22) to engage in the positioning hole (23) located below the positioning hole (22), the pawl (43) has a second positioning possibility, and thereby prevents an umbrella from opening due to the careless pushing of the spring actuator or accidental impact (as indicated in FIG. 6). Furthermore the design of the contoured leaf spring (40) is of sufficient resilience to ensure the safety and comfort of the user.

What is claimed is:

1. A hidden safety contoured leaf spring positioning system for an umbrella structure comprising:

(a) a longitudinally directed tubular center pole defining an inner wall thereof having a through opening and a longitudinally directed through slot formed in a lower section thereof;

(b) a strut spreader slidingly engaged to an external surface of said tubular center pole, said strut spreader having a longitudinally directed through opening defining an internal wall of said strut spreader and a positioning slot formed within an upper section of said internal wall of said strut spreader;

(c) a hollow positioning tube contiguously mounted between said external surface of said tubular center pole and said internal wall of said strut spreader, said hollow positioning tube having a protruding tab extending from an upper section thereof and inserted into said positioning slot, said positioning tube having an upper and a lower positioning hole formed therethrough;

(d) a handle connector slidably engaged with said external surface of said tubular center pole having an insertion hole formed therethrough;

(e) a contoured leaf spring mounted internal said tubular center pole, said contoured leaf spring having a lower end in contact with a spring actuator member extending through said insertion hole of said handle connector, said contoured leaf spring having an upper section forming an elongated arched member contacting said internal wall of said tubular center pole, said contoured leaf spring having an upper end inserted within said tubular center pole through opening for supporting said contoured leaf spring, said contoured leaf spring having a central section having a pawl member inserted into a positioning hole formed through said strut spreader, whereby said pawl member is engaged within said upper positioning hole when said umbrella is closed and said pawl member is engaged within said lower positioning hole when said umbrella is opened.

* * * * *